United States Patent [19]

Roberts

[11] 3,957,038

[45] May 18, 1976

[54] MASSAGE UNIT CONSOLE

[76] Inventor: Theodore S. Roberts, 26151 Lake Shore Blvd., Apt. 521, Euclid, Ohio 44132

[22] Filed: June 6, 1975

[21] Appl. No.: 584,344

[52] U.S. Cl. ..... 128/24 R; 128/32; 312/237

[51] Int. Cl.[2] ..... A61H 1/00

[58] Field of Search ..... 128/24 R, 24.1, 33–36, 128/41, 66; 312/21, 28, 237

[56] References Cited

UNITED STATES PATENTS

| | | | |
|---|---|---|---|
| 2,566,484 | 9/1951 | Coury | 128/33 |
| 2,674,994 | 4/1954 | Murphy | 128/36 |
| 3,062,203 | 11/1962 | Ziff | 128/24.1 |
| 3,092,099 | 6/1963 | Berard | 128/33 |
| 3,267,936 | 8/1966 | Brady | 128/66 |
| 3,742,941 | 7/1973 | Aizehstat | 128/33 |

*Primary Examiner*—Lawrence W. Trapp
*Attorney, Agent, or Firm*—Fitzpatrick, Cella, Harper & Scinto

[57] ABSTRACT

A massage unit console for maintaining for use and storage electrically powered massage equipment. The console includes a box-like container for containing the equipment and having a lid that opens in a manner to hold a massage control in a stable manner and in proper position for convenient operation.

10 Claims, 4 Drawing Figures

MASSAGE UNIT CONSOLE

BACKGROUND OF THE INVENTION

1. Field of the Invention

This invention relates to consoles for electrically powered massage systems and more particularly it concerns a novel container system in which massage pads and control panels are carried and which opens in a manner to bring the control panels to a conveniently useable operating position.

2. Description of the Prior Art

Electrically powered massage systems of the type which may be used with the present invention are illustrated in U.S. Pat. Nos. 2,852,020 and 2,917,043. In general, these systems comprise a cushion like pad with flat expansive surfaces. A motor unit is attached to one edge of the pad; and this motor unit drives a mechanism within the pad to provide a vibratory action therein. This vibratory action is communicated through the pad to produce a massage effect on a person against whom the pad is applied. Electrical heating means may be provided within the pad to supply heat along with the massaging effect. A control panel is electrically connected to the pad so that the heat and vibratory action can be adjusted during use. Often a small hand held massage unit of the type shown in U.S. Pat. No. 2,674,994 is provided for applying massage to localized areas for example to the face and neck; and this also may have its own separate control panel.

The above described massage systems with their associated electrical controls have proven to be cumbersome in many situations. This is due, in part, to the fact that the user often must be sitting or lying in a special position during use of the equipment and long electrical cords must be provided between the massage unit itself and an electrical control panel; which additional electrical cords must extend from the control panel to an electrical source, such as a wall outlet. Also, because the equipment includes many accessories, it tends to clutter the area; and this presents a problem of storage between uses.

In the past, massage equipment has been stored either in closets or on shelves, where it was not conveniently accessable; or else it was stored in suitcase type containers. The suitcase type containers were provided with pockets inside the lid to hold various equipment components such as control panels and massage hand units, while the massage pad itself was held in the main body portion of the container. This suitcase type arrangement was inconvenient, however, because it had to be laid open on the floor or else placed on a table and opened in order to ready the equipment for use. When the massage pad was taken out, the weight of the control panels and massage hand unit, which were carried in the lid, weighed the lid down so that they were not held solidly in a position convenient for use.

The present invention overcomes these difficulties of the prior art. According to the present invention there is provided a novel massage unit console arrangement comprising a box-like container having relatively narrow bottom, top and end walls and relatively wide side walls, dimensioned to hold a massage pad therein so that it lies in a generally upright position with one edge lying along the bottom wall of the container.

The top wall of the container is hinged along the top edge of one of the wide side walls. In addition, there are provided mounting means for mounting a massage unit control panel to the underside of the top wall so that when the top wall is closed the control panel is concealed inside the massage unit along with the massage pad. Further, stop means are provided to limit the opening of the top wall to a degree such that it holds the control panel in a stable manner and in a readily accessible position.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

One embodiment of the invention has been chosen for purposes of illustration and description, and is shown in the accompanying drawings forming a part of the specification, wherein.

DETAILED DESCRIPTION OF THE PREFERRED EMBODIMENT

Figure 1:
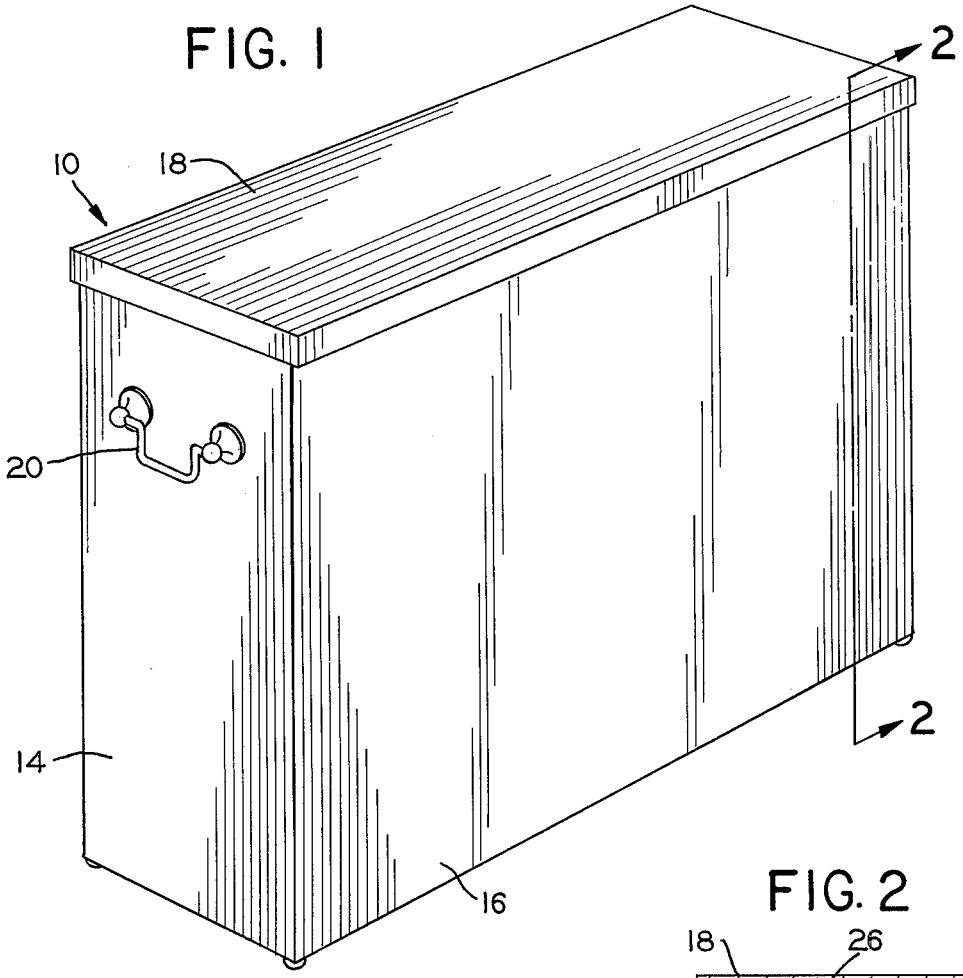
FIG. 1 is a perspective view of a massage unit console in which the present invention is embodied.
Figure 2:
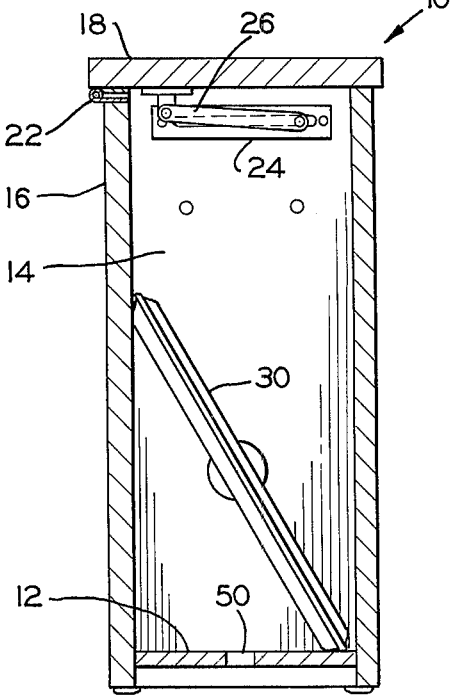
FIG. 2 is a section view taken along line 2—2 of FIG. 1.

As shown in FIG. 1, a massage unit console 10, according to the present invention, is exteriorly configured to resemble a cabinet or end table which may be positioned adjacent a bed or a chair (not shown). The console 10, as shown in FIGS. 1 and 2 is of generally box-like configuration; and it is formed with a narrow rectangular bottom wall 12 and narrow rectangular end walls 14, as well as a pair of expansive side walls 16. A cover or top wall 18 rests on top of the container 10; and this top wall is preferably large enough to overhang slightly beyond the end and side walls 14 and 16. Handles 20 are mounted on the end walls 14 for carrying the console.

Figure 3:
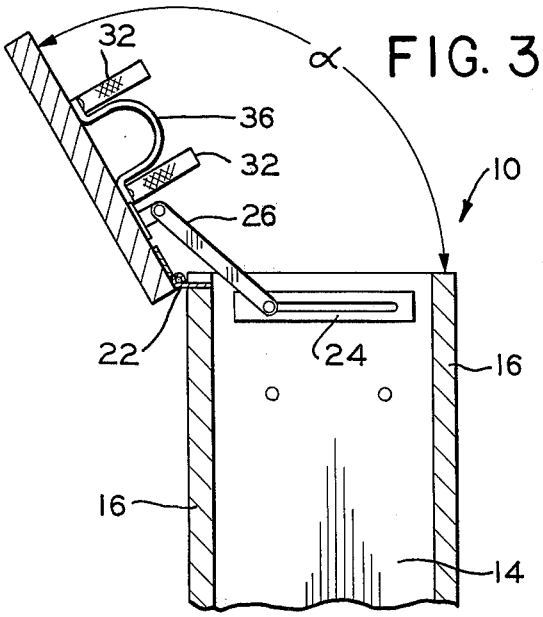
FIG. 3 is a fragmentary section view similar to FIG. 2 but showing the console in opened condition.
Figure 4:
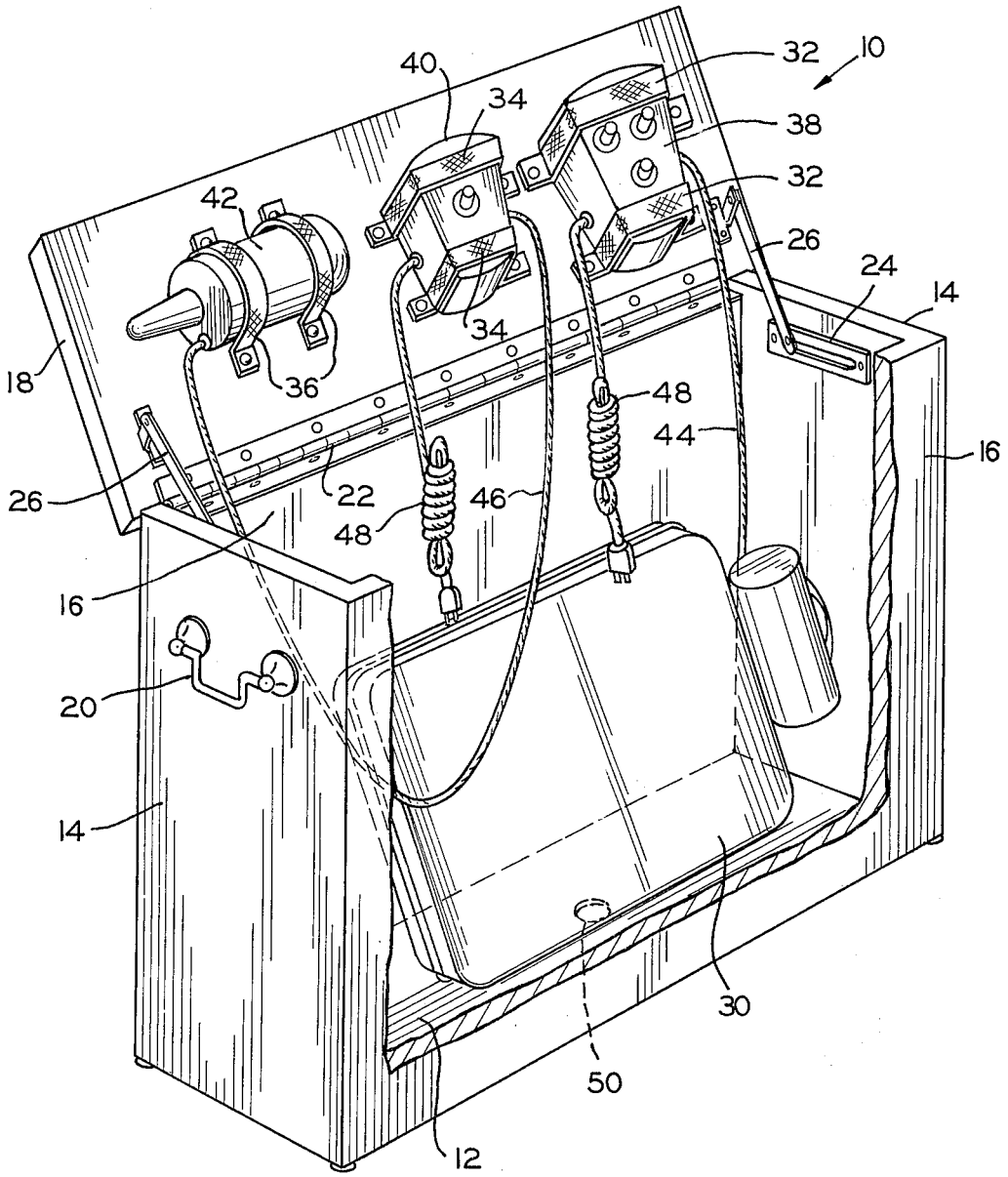
FIG. 4 is a perspective view similar to FIG. 1 but showing the console opened and partially cut away.

As shown in FIGS. 2, 3 and 4 the top wall 18 is hinged along the upper edge of one of the side walls 16 by means of a piano type hinge 22. This allows the top wall to swing from its closed position, shown in FIGS. 1 and 2, to an open position, shown in FIGS. 3 and 4.

Stop means are provided to limit the degree to which the top wall 18 may be opened. This stop means, as shown in FIGS. 2, 3 and 4, includes slide brackets 24 mounted to extend near and parallel to the upper inside edges of the end walls 14. Slide links 26 are pivotally connected at one end to the top wall 18 and are slideably connected at their opposite end, to the slide brackets 24. As will be explained more fully hereinafter the slide brackets 24 and the links 26 are dimensioned to allow the top wall 18 to swing through an arc $\alpha$ of about 142° in pivoting to its fully opened position.

The top, end and side walls 18, 14 and 16 of the console 10 are of rather sturdy construction and are preferably made of wood or a wood composition about 9/16 inches (1.4 cm) thick; although plastic materials may also be used. The overall dimensions of the console 10 are such that its height is about 18 inches (46 cm), its length is about 25 inches (63 cm), and its width is about 9 inches (23 cm).

As shown in FIG. 4, an electrically powered massage pad 30 fits inside the console 10 so that it lies along one edge with its expansive surfaces or wide sides extending in a generally upright direction. It will be appreciated that the particular dimensional relationships employed in the console 10, i.e. with relatively narrow top bottom and end walls 18, 12 and 14 and relatively wide side walls 16, cause the massage pad 30 to lie along one edge thereof inside the console. The significance of this particular arrangement will be described hereinafter.

Elastic strap type component mounting brackets 32, 34 and 36 are secured to the surface of the top wall 18 which faces inwardly of the console 10 when the top wall is closed. These mounting brackets are shown to be attached to the top wall by means of screws, although they may be glued or held in any other suitable manner. As shown in FIG. 4, the brackets 32 extend over and hold a massage pad control panel 38 securely to the top wall 18; although the control panel 38 can be removed, if desired. Similarly, the brackets 34 hold a massage hand unit control panel 40 to the top wall while the brackets 36 hold a massage hand unit 42 to the top wall. The control panels 38 and 40 are connected, respectively, to the massage pad 30 and to the massage hand unit 42 by means of electrical cables 44 and 46. These control panels are also provided with electrical cords 48 which may be plugged in to any convenient electrical outlet for powering the massage equipment. A hole 50 is formed in the bottom wall 12 to allow the cords 48 to extend out from the console.

When the massage equipment is not in use, the massage pad 30 is placed inside the console 10, so that it lies therein along one edge; and the top wall 18 is then closed. All of the massage equipment, including the control panels 38 and 40, the massage hand unit 42 and the massage pad 30 are thus completely concealed within the console although they are readily available for use at any time. The cords 48 from the control panels 38 and 40, which pass out through the bottom hole 50, may be left plugged in to an electrical outlet. The console 10 may serve as a bench or a table or simply as a cabinet or other piece of furniture when the massage equipment is not being used.

When it is desired to use the massage equipment, the top wall 18 of the console is lifted up to its open position as shown in FIGS. 3 and 4. This allows the massage pad 30 and/or the massage hand unit 42 to be taken out for use. At the same time, the opening of the top wall 18 automatically brings the control panels 38 and 40 to a convenient operating position so that they are easily accessible to a person sitting in a chair or lying on a bed near the console and using the massage equipment.

It will be noted that because the top wall 18 is narrow and is hinged along its long dimension, its pivoting to an opened position has relatively little effect upon the center of gravity of the console. Moreover, the same configuration of the console which allows the top wall 18 to be hinged in this manner also serves to hold the massage pad 30 on its edge, so that when the massage pad 30 is removed for use the absence of its weight has only minimal effect upon the center of gravity. Because of this it is possible to hold the control panels 38 and 40 in their operative position in a stable manner.

It will be appreciated from the foregoing that the narrow upright configuration of the console 10 with its top wall hinged along one of the wide side walls serves to permit the top walls to be moved to a position for convenient operation of the control panels while holding the control panels in a firm and stable manner irrespective of whether the massage pad and the hand massage unit are in place within the console or are removed from the console for use. It is, of course, important that the center of gravity of the console always remain forwardly of the hinge 22, i.e. to the right of the hinge as viewed in FIG. 2, in order to avoid tipping. This is ensured by means of the brackets 24 and slide links 26 which, as above described, serve as stop means to limit the amount by which the top wall 18 can swing open. As pointed out above, the length of the links 26 is such that they limit the top 18 to swing up through an angle $\alpha$ of about 142°. This allows the center of gravity of the top 18, along with the control panels 38 and 40 and the massage hand unit 42 to move beyond the hinge line of the hinge 22, i.e. to the left of the hinge 22 as viewed in FIG. 3, so that the top 18 will remain open. At the same time, the center of gravity of the top 18, with the control panels 38 and 40 and the massage hand unit 42 is maintained sufficiently close to the hinge 22 so that the overall center of gravity of the console 10, without the massage pad 30, remains between the two side walls 16. Thus the console remains upright and stable; and it holds the control panels 38 and 40 securely in a position where they are conveniently accessible for viewing and adjustment. Of course, the massage hand unit can be removed from its bracket for use without upsetting the center of gravity relationships described above. Likewise, the control panels 38 and 40 may themselves be removed for repair or replacement or for particular use applications. In normal operation however these control panels will remain securely mounted on the underside of the top wall 18. Thus after use of the massage equipment, the massage pad 30 may be replaced in the console 10 and the top 18, with the control panels 38 and 40 and the massage hand unit 42 mounted thereon, may be closed so that all of the equipment is neatly and conveniently stored inside the console.

Because the interior of the console 10 is dimensioned to retain the massage pad 30 along one edge, the console 10 is enabled to position the control panels for convenient use without danger of tipping. This results from the fact that the console 10 in this configuration provides the top wall 18 at a conveniently accessible height for use of the control panels. Further, by providing an elongated hinge along the top edge of one of the wide walls 16 the amount by which the overall center of gravity is shifted upon opening the top 18 in minimized.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A massage system console for use with electrically powered massage pads having generally flat, expansive surfaces, said console comprising a generally rectangular box-like container having narrow bottom, top and end walls and a pair of relatively wide side walls which accommodate therein a massage pad with its flat expansive surfaces lying in generally vertical planes, hinge means extending along the upper edge of one of said wide side walls and hingeably connected said one side wall to said top wall to permit said top wall to swing up to open the console at its top, massage pad control panel mounting means on the surface of said top wall which faces inside said container when the top wall is closed for mounting a control unit in a manner such that it is held within said container when the top wall is closed but is automatically brought to an exposed and operative position when the top wall is opened and stop means arranged to limit the opening of the top wall to a position such that the weight of the control unit and top wall are sufficient to maintain the top wall opened but insufficient to overturn said container.

2. A massage system console according to claim 1 wherein said stop means is positioned to allow said top wall to swing through an arc of about 142° from a fully closed position to a fully opened position.

3. A massage system console according to claim 1 wherein said mounting means comprises an elastic strap-like element affixed to said top wall for resiliently holding a massage pad control unit against said top wall.

4. A massage system console according to claim 1 wherein said bottom wall is formed with an opening through which an electrical power supply cord may extend.

5. A massage system console according to claim 1 wherein said stop means comprises a slide bracket extending along one of the narrow end walls near its top edge and a link, one end of which is pivotally connected to said top wall and the other end of which slides in said bracket.

6. A massage system comprising a generally rectangular box-like container having narrow bottom, top and end walls and a pair of relatively wide side walls, an electrically powered massage pad having generally flat expansive surfaces, said massage pad resting in a generally upright position in said container with one edge of said massage pad resting on said bottom wall, hinge means extending along the upper edge of one of said wide side walls and hingeably connecting said one side wall to said top wall to permit said top wall to swing up to open the console at its top, a massage pad control panel mounted on the surface of said top wall which faces inside said container when the top wall is closed so that the control unit is held in such a manner that it is held within the container, along with said massage pad, when the top wall is closed but is automatically brought to an exposed and operative position when the top wall is opened, stop means arranged to limit the opening of the top wall to a position such that the weight of the control unit and top wall are sufficient to maintain the top wall opened but are insufficient to overturn said container, a first electrical cord carried in said container and extending for said control unit to said massage pad and a second electrical cord extending from said control unit out through an opening in said container.

7. A massage system according to claim 6 wherein said stop means is positioned to allow said top wall to swing through an arc of about 142° from a fully closed position to a fully opened position.

8. A massage system according to claim 6 wherein said opening is formed in said bottom wall.

9. A massage system according to claim 6 wherein a massage hand unit and a massage hand unit control panel are mounted on the surface of said top wall adjacent said massage pad control panel and wherein at least said massage hand unit is removable from said top wall.

10. A massage system according to claim 6 wherein said stop means are positioned to allow the top wall to open to a position such that its center of gravity along with the massage pad control panel is outside said side walls while the overall center of gravity of said system remains between said side walls.

* * * * *